US005083401A

United States Patent [19]

Yamashita et al.

[11] Patent Number: 5,083,401

[45] Date of Patent: Jan. 28, 1992

[54] METHOD OF POLISHING

[75] Inventors: Mikio Yamashita; Shigekazu Hara; Hiroyuki Matsunaga, all of Hyogo; Tooru Mamiya; Masakazu Hamada, both of Kanagawa, all of Japan

[73] Assignee: Mitsubishi Denki Kabushiki Kaisha, Tokyo, Japan

[21] Appl. No.: 315,414

[22] Filed: Feb. 23, 1989

[30] Foreign Application Priority Data

Aug. 8, 1988 [JP] Japan ..... 63-197543
Aug. 8, 1988 [JP] Japan ..... 63-197544

[51] Int. Cl.[5] ..... B24B 49/00

[52] U.S. Cl. ..... 51/165.71; 51/165.77; 51/283 R; 51/325

[58] Field of Search ..... 51/92 R, 93, 165 R, 51/165.71, 165.77, 283 R, 325, 317, 392, 5 D, 327, 206 P, 131.4, 206 R, 209 DL, 93, 165.76

[56] References Cited

U.S. PATENT DOCUMENTS 2,372,427 3/1945 Johnson ..... 51/165 R X
3,583,110 6/1971 Scott ..... 51/283
3,694,965 10/1972 McLeod ..... 51/93
4,370,835 2/1983 von Schneidemesser ..... 51/165.77
4,485,594 12/1984 Guertin ..... 51/35 X
4,735,019 4/1988 Wiederkehr ..... 51/93 X
4,771,578 9/1988 Jorgensen et al. ..... 51/165.77
4,942,695 7/1990 Wedeniwski ..... 51/289 R X

FOREIGN PATENT DOCUMENTS 0261227 11/1926 United Kingdom ..... 51/206 P

*Primary Examiner*—M. Rachuba
*Attorney, Agent, or Firm*—Wolf, Greenfield & Sacks

[57] ABSTRACT

A rotor is formed by rotationally cutting a metal mass mounted on a machine tool shaft under computer control, and also its outer periphery is formed with annular grooves by rotational cutting. The rotor is rotated on a shaft while feeding an abrasive to it, while a workpiece set on a stage movable along three perpendicular axes, i.e., X-, Y and Z-axes, urged against the rotor by moving the stage in the Z-axis direction. The surface of the workpiece is polished by causing the stage to be moved in the X-axis direction and reciprocated in the Y-axis direction, the urging pressure being controlled by measuring it with a pressure sensor.

17 Claims, 6 Drawing Sheets

METHOD OF POLISHING

BACKGROUND OF THE INVENTION

1. Field of the Invention

This invention relates to a method of polishing electronic parts or like workpieces in the form of thin plates.

2. Description of the Prior Art

Recently, highly precisely machined thin plates of ceramics are extensively used as substrates of electronic parts. For example, alumina titanium carbide ($Al_2 2O_3$/-Tic) is used as a substrate of a thin film head of a computer, and the head requires very high accuracy such as a throat height of $1.5 \pm 0.5$ μm, a flatness of 0.04 μm and a surface roughness of 0.02 μm.

FIGS. 8 to 10 illustrate a prior art method of polishing for the throat height. In this method, chips 10 cut to unit size are bonded to a work support disk 11 by adhesive 12 capable of being thermally softened as shown in FIG. 8, and they are polished in a manner as shown in FIG. 9.

FIG. 10 shows a block-like workpiece 1, which is cut into the chips 10. Reference numeral 14 designates dashed lines, along which the block 1 is cut into the chips 10, and numeral 15 designates a phantom line, up to which the block 1 is polished from the top. Designated at $d_1$, $d_2$, . . . are polishing margins of the block from the top thereof to the position of the phantom line 15. As is shown, the polishing margin varies (such as $d_2 > d_1$) with the individual chips 10, which are cut from the elongate block 1, because of problems in the manufacture of the block 1 (dicing process of wafers).

Further, the adhesive 12 used to bond the chips 10 to the disk 11 fluctuates in thickness in the order of microns.

In FIG. 9, a large-size lapping disk 13 is rotated while supplying abrasive particles 3 from an abrasive feeder 4, and the work support disk 11 facing the abrasive feeder 13 is rotated. In this way, the chips 10 are polished with the abrasive 3 on the top surface of the lapping disk 13.

In the method of polishing shown in FIG. 9, the rotation of the lapping disk 13 is stopped for every several ten seconds, the work support disk 11 is removed from the lapping disk 13, the polishing status of the individual chips 10 is observed with a microscope, and chips which have been completely polished are removed.

FIG. 11 shows a different prior art method of polishing In this case, a sensor 17 for detecting a desired extent of polishing is provided at each of the opposite ends of block-like workpiece 1. This block-like workpiece 1 is directly bonded to the work support disk 11 and polished on the lapping disk 13 shown in FIG. 9. In this method, the machining is performed while on-line measuring the extent of polishing. (After polishing, the work is cut into the chips.)

The first-mentioned prior art method of polishing, however, involves a large number of steps and requires some manual operation and long time of operation. In the second-mentioned prior art method, since the thickness of the block-like workpiece varies locally, it is very difficult to mount the sensors at intended positions accurately. Thus, a considerable time is required for positioning, and the yield is inferior.

SUMMARY OF THE INVENTION

An object of the invention is to provide an apparatus and a method of highly precise polishing, which permits automatic polishing and minimization of manual operation.

To attain the above object of the invention, there is provided a method of polishing, which comprises the steps of forming a rotor by cutting a metal mass rotating on a machine tool shaft under computer control, rotating the rotor while feeding an abrasive thereto, urging a workpiece set on a three-dimensionally movable stage against the rotor by three-dimensionally moving the stage and polishing the workpiece with the abrasive while measuring the pressure, with which the workpiece is urged by using a pressure sensor.

The above and other objects, features and advantages of the invention will become more apparent from the following description when taken in conjunction with the accompanying drawings.

DESCRIPTION OF THE PREFERRED EMBODIMENTS

A first embodiment of the invention will now be described with reference to the drawings.

Figure 1:
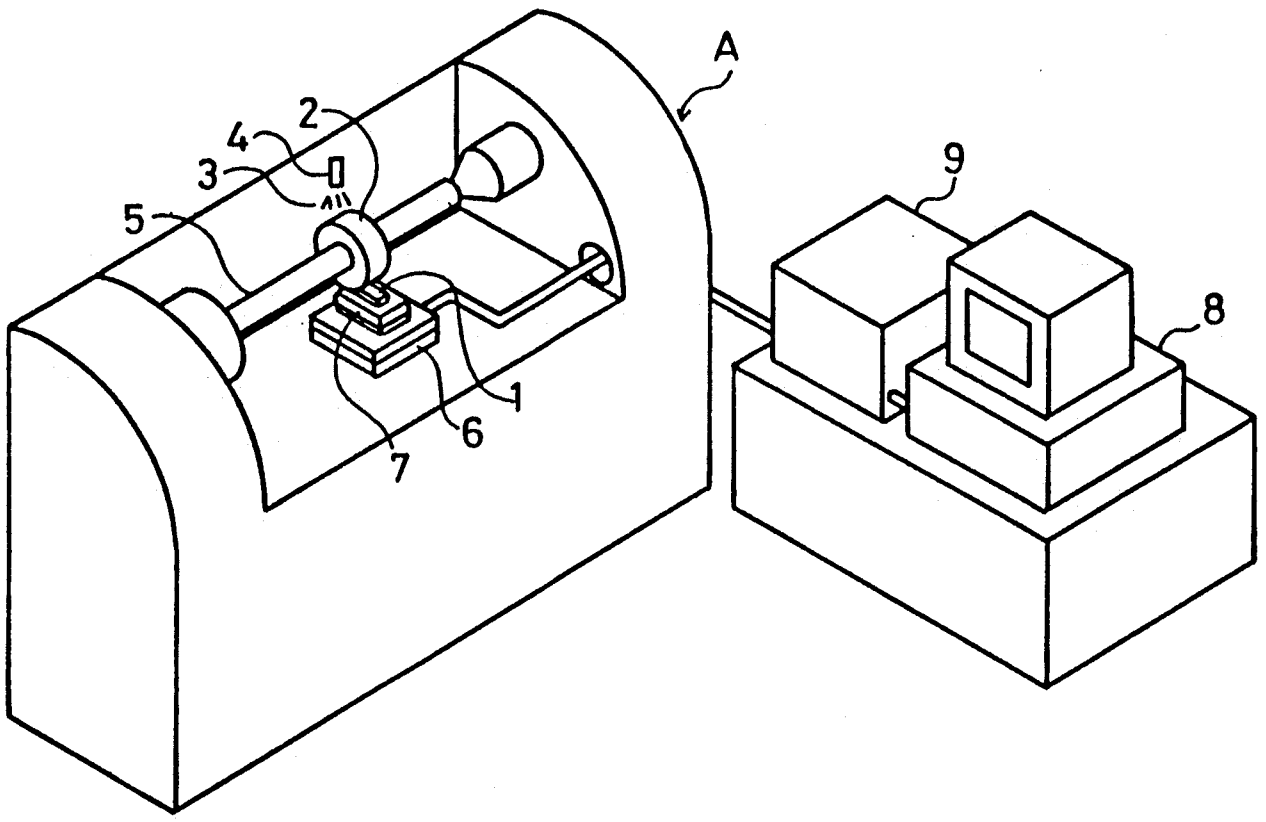
FIG. 1 is a perspective view showing a polishing apparatus according to the invention.

FIG. 1 is a view showing a polishing apparatus using a machine tool for explaining the method according to the invention. Referring to the Figure, a machine tool A performs a rotational cutting. Reference numeral 1 designates a block-like workpiece consisting of a ceramic material, and 3 abrasive particles fed from an abrasive feeder 4. The block-like workpiece 1 is a thin plate having a thickness of about 1 mm.

Reference numeral 2 designates a cylindrical lapping rotor, 5 a precision shaft of the machine tool A, 6 an XYZ-stage, 7 a pressure sensor, 8 a personal computer, and 9 an NC controller. The cylindrical lapping rotor 2 is obtained by mounting a mass of a metal, for instance tin, on a machine tool shaft and cutting it by rotating the shaft into a precise cylindrical form.

Figure 2:
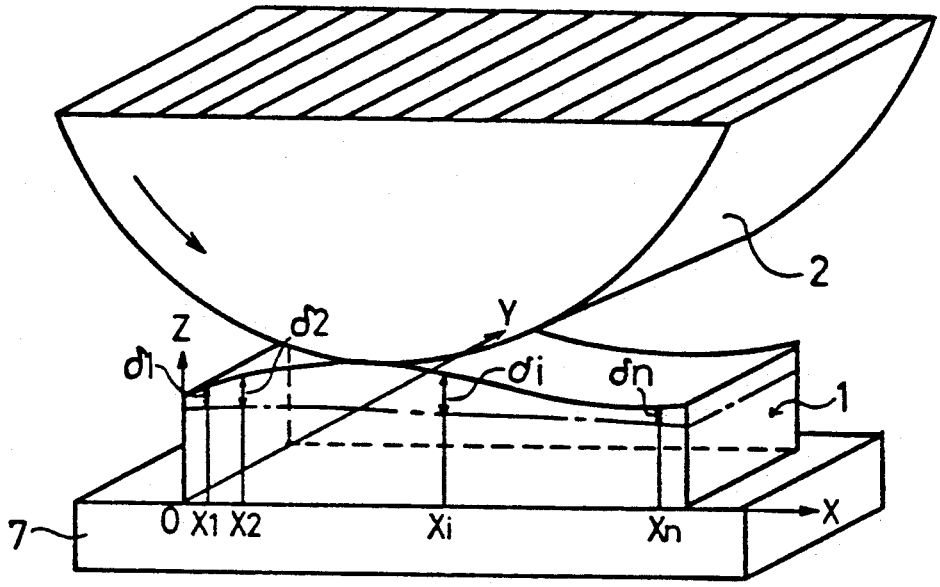
FIG. 2 is a fragmentary enlarged-scale perspective view showing a first embodiment of the invention.

FIG. 2 shows, to an enlarged scale, a polishing section of a first embodiment of the invention. The lapping rotor 2 is provided coaxially and rotatably on the precision shaft 5. The workpiece 1 is set on the pressure sensor 7. The pressure sensor 7 detects the pressure, with which the workpiece 1 is pressed between the XYZ-stage 6 and lapping rotor 2, and its output is supplied to an NC controller 9 and personal computer 8. The NC controller 9 controls the rotation of the shaft 5 and movement of the XYZ-stage 6.

Now, the method of polishing will be explained. The cylindrical lapping rotor 2 is first formed by mounting a mass of a metal, for instance tin, on the precision shaft 5 and cutting it by rotating the shaft. Then, the block-like workpiece 1 is moved by the XYZ-stage 6 with respect to the lapping rotor 2 according to a command from the NC controller 9. Then, the surface of the block-like workpiece 1 is polished with the abrasive supplied from the abrasive feeder 4 on the outer periphery of the cylindrical lapping rotor 2. At this time, the extent of polishing of the workpiece 1 in the Z-axis direction at each X-axis point, extent of movement in the Y-axis direction and polishing rate are input in advance as initial polishing condition data to the personal computer 8. The personal computer 8 calculates the extents and speeds of movement in the three, i.e., X-, Y- and Z-axes directions and produces a control program on the basis of the results of calculations. The control program is supplied to the NC controller 9, and the XYZ-stage 6 is moved according to the program, thus obtaining a machined surface after grinding to a desired extent. The extent of polishing of the workpiece 1 in the Z-axis direction at each typical X co-ordinate Xi corresponds to $\delta_1$, $\delta_2$, . . . shown in FIG. 2. A polishing extent function $\delta(x)$ by performing interpolation between points $X_1$ and $X_2$ using values obtained by measurement with a probe type measuring machine, a corresponding speed of movement in the X-axis direction is calculated, and the polishing is appropriately controlled such that the extent of polishing is reduced with speed increase.

Figure 3:
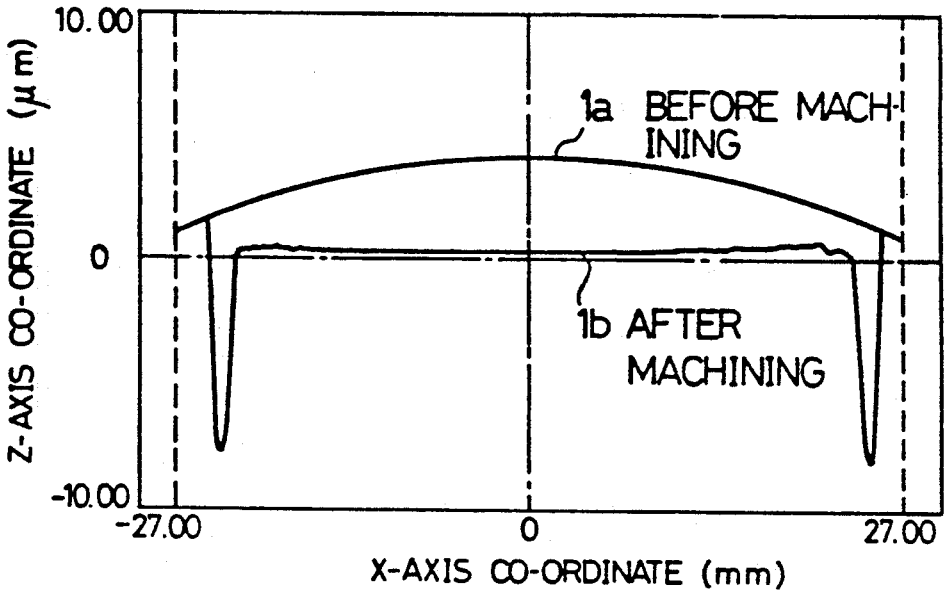
FIG. 3 is a graph showing a result of machining in the first embodiment.

FIG. 3 shows measured height in the X-axis direction of the workpiece 1 actually polished using the present apparatus plotted in the X-axis direction. In the graph, the ordinate is taken for the Z-axis co-ordinate in μm, and the abscissa is taken for the X-axis co-ordinate in mm. Plot 1*a* represents the shape of the workpiece before machining, and plot 1*b* the shape after machining. It is shown that the workpiece surface before machining, which is convex in shape by about 2 μm at the most from the desired plane, is polished to be flat. The extent of polishing ($X_i$, $\delta_i$) is input for 10 X-axis co-ordinate points. It will be seen that the desired shape can be obtained by polishing with accuracy of 0.3 μm or less.

Figure 4:
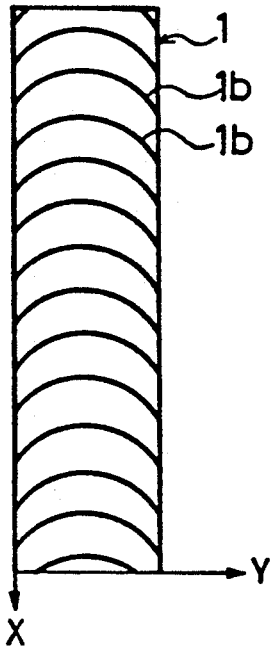
FIG. 4 is a view showing a surface shape obtained in the first embodiment.

FIG. 4 shows a high-precision contour-line diagram of the surface of the workpiece in the X-Y plane. Contour lines 1*b* represent the shape after the machining, and there are interference fringes obtained when the flatness of the surface is measured using a He-Ne laser. The contour lines 1*b*, which show the same height level, are arcuate in shape. Irregularities of about 0.4 μm are produced over the entire area in the short axis direction (i.e., Y-axis direction in FIG. 4) of the workpiece 1, but the surface is smoothed up to a surface roughness of 0.09 μm.

Figure 5:
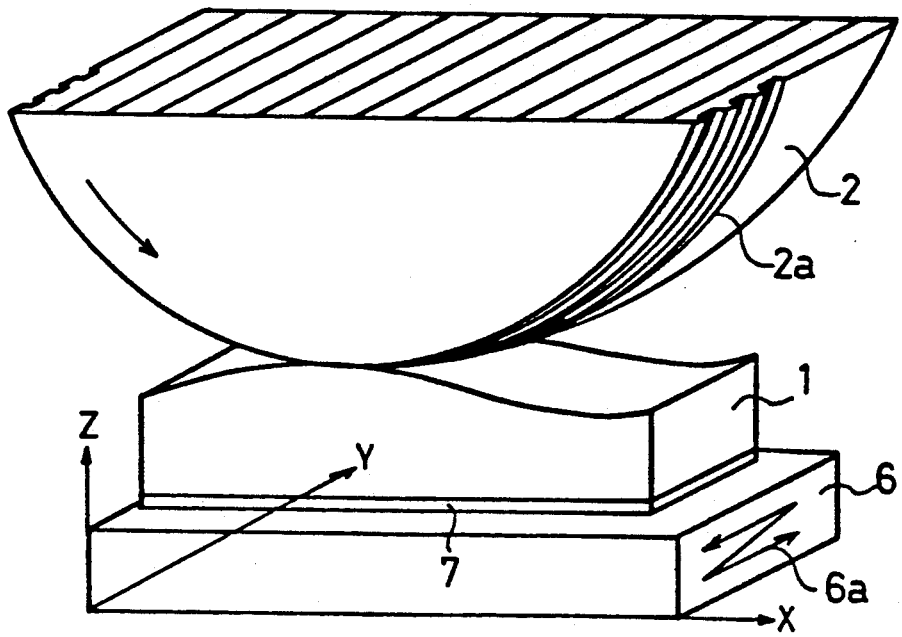
FIG. 5 is a view similar to FIG. 2 but showing a second embodiment of the invention.

Now, a second embodiment of the invention will be described. FIG. 5 is an enlarged-scale perspective view showing a stage, a machining tool, etc. of a machine tool for performing rotational grinding. In this embodiment, the outer periphery of cylindrical lapping rotor 2 is partly removed by forming a plurality of annular grooves 2*a*. More specifically, several annular grooves 2*a* are formed accurately by removing corresponding outer periphery portions of the cylindrical lapping rotor 2.

Figure 6:
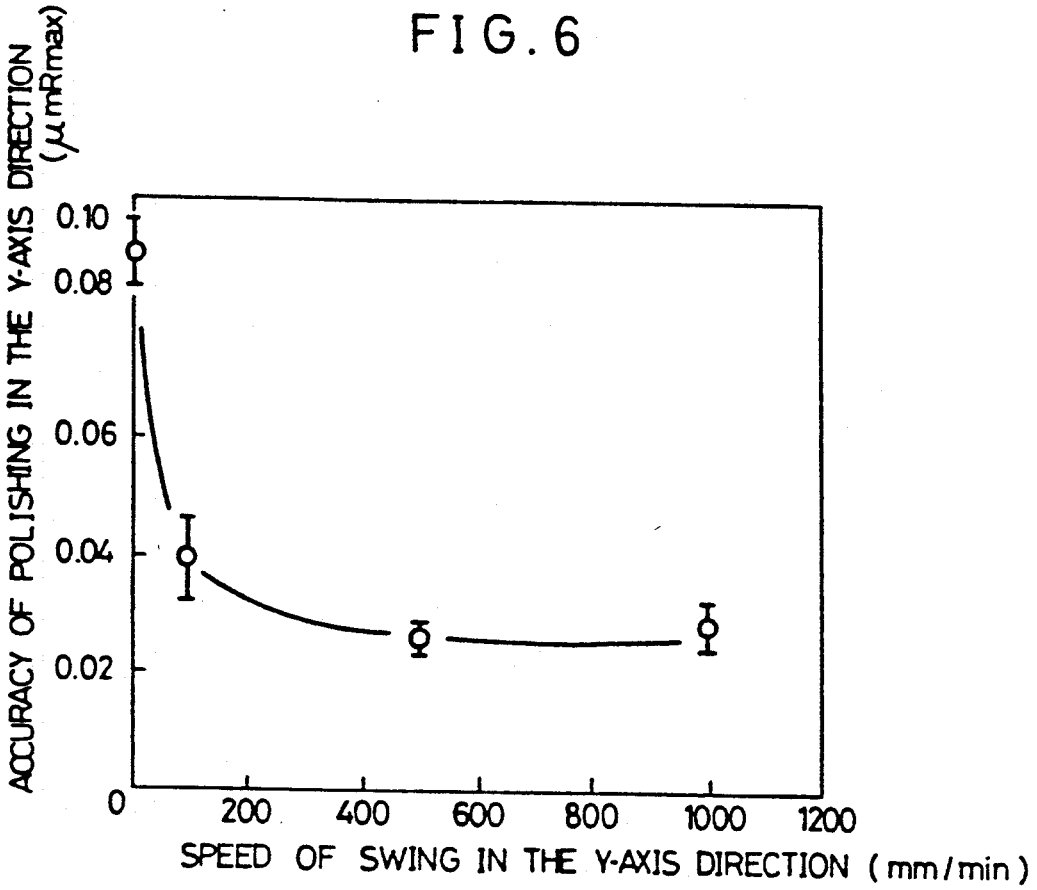
FIG. 6 is a graph showing a result of machining in the second embodiment.
Figure 7:
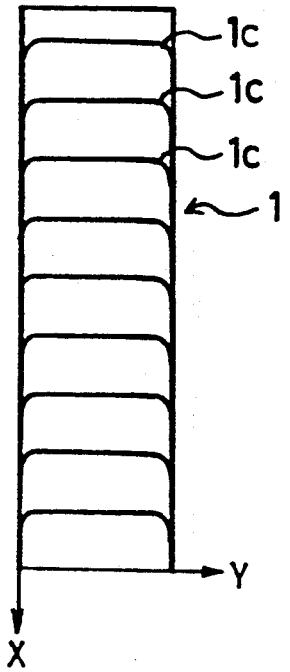
FIG. 7 is a view similar to FIG. 4 but showing a surface shape obtained in the second embodiment.
Figure 8:
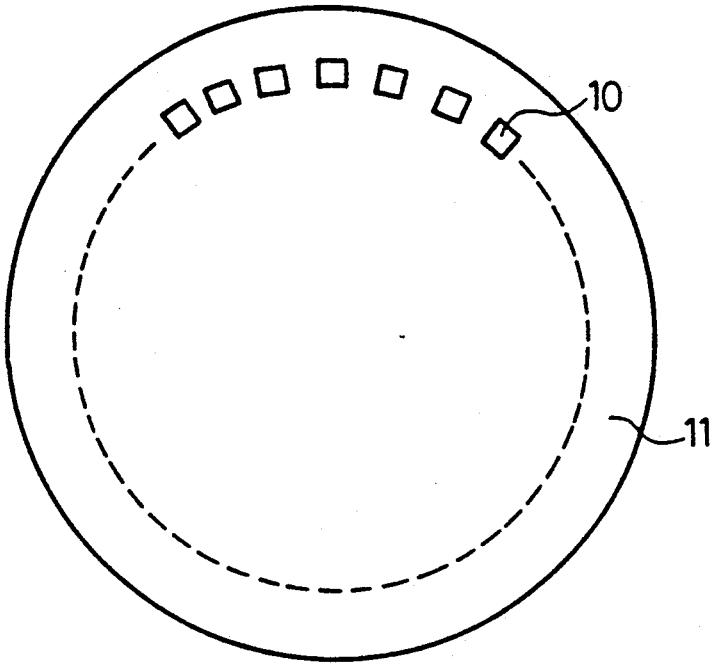
FIG. 8 (PRIOR ART)
FIG. 8 is a plan view showing workpiece chips set on a work support disk in a prior art polishing apparatus.
Figure 9:
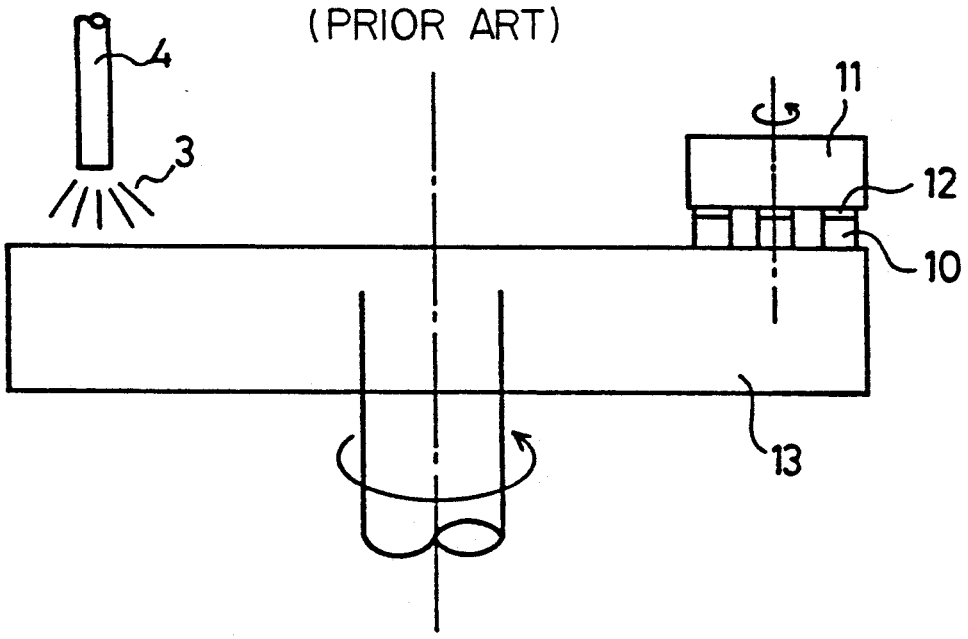
FIG. 9 (PRIOR ART)
FIG. 9 is a side view showing the prior art chip polishing apparatus.
Figure 10:
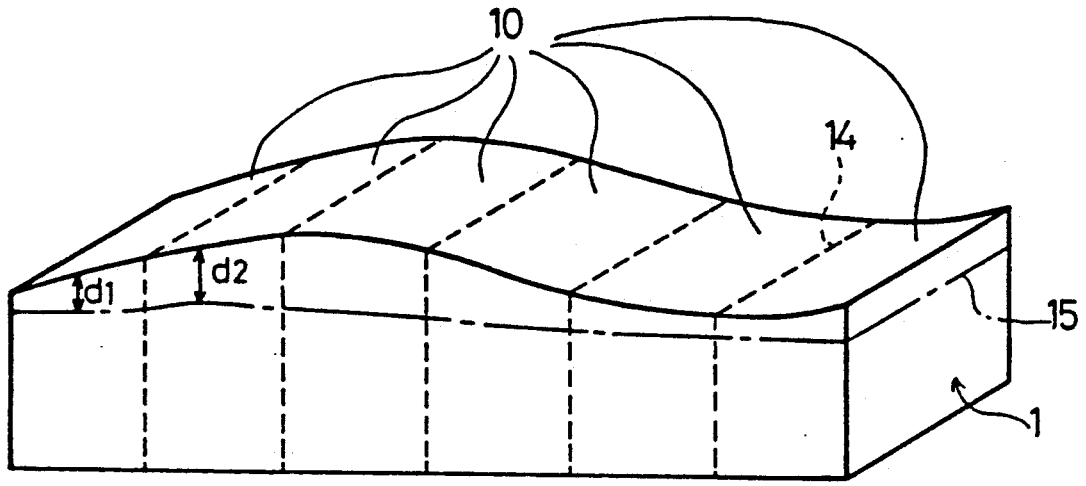
FIG. 10 (PRIOR ART)
FIG. 10 is a perspective view showing a prior art block-like workpiece.
Figure 11:
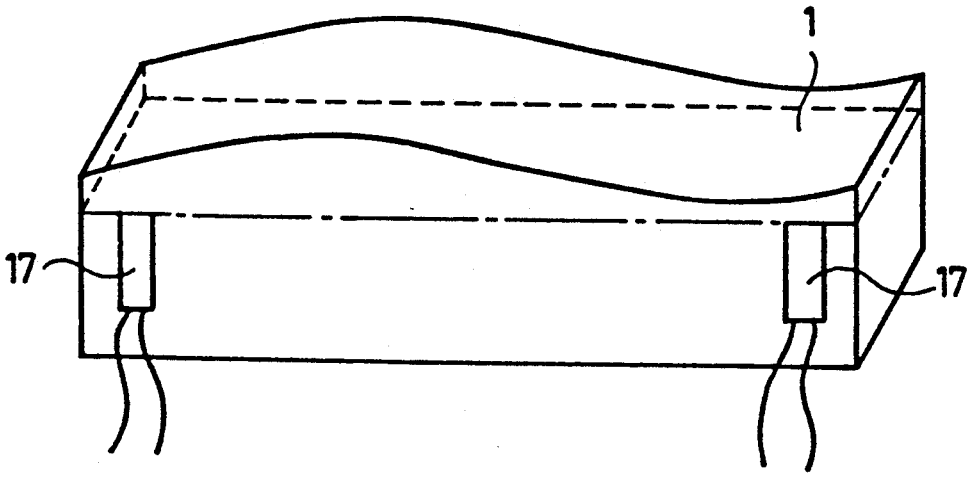
FIG. 11 (PRIOR ART)
FIG. 11 is a view showing a different prior art method of polishing.

Now, the operation will be described. The lapping rotor 2 is rotated, while moving the XYZ-stage 6 under control of the NC controller. At this time, the workpiece 1 is urged against the rotating lapping rotor 2 with programmed urging force while feeding industrial diamond abrasive particles. The urging pressure is measured by the pressure sensor 7, and the polishing is performed with the abrasive while it is monitored by the NC controller. A program with the polishing load, extent of polishing of the workpiece in the Z-axis direction at each X-axis cordinate, extent of swing in the Y-axis direction, rate of polishing, etc. as initial polishing condition data, is input in advance to a personal computer or the like. Particularly, the stage 6 is reciprocated in the Y-axis directions as shown at 6*a* in FIG. 5 at a programmed frequency while moving it in the X-axis direction. Consequently, the corners of the annular grooves 2*a* grind the surface of the workpiece 1 with the reciprocation of the stage in the Y-axis directions in addition to the grinding with the rotation of the stage. The polishing thus is executed along a zigzag trace from one end to the other in the X-axis direction. FIGS. 6 and 7 show results of actual polishing performed by the method as described. Designated at 1*c* in FIG. 1 are interference fringes, which are obtained when the flatness of the finished workpiece is measured using a He-Ne laser and represent the shape of the finished workpiece. As shown in FIG. 6, by increasing the speed of swing in the Y-axis direction the accuracy of polishing in the Y-axis direction is improved. As an example, while the accuracy obtainable in the previous first embodiment is 0.09 μm as Rmax value, the value can be reduced to 0.025 μm with incorporation of the swing at 500 mm/min. or above. Further,.the obtainable flatness, which was 0.4 μm in the first embodiment, can be improved to 0.15 μm in this embodiment as shown in FIG. 7. The contour lines 1*c* are substantially parallel to the Y-axis direction in the X-Y plane, indicating that more uniform grinding can be obtained compared to the first embodiment.

While a cylindrical lapping rotor is employed in the above embodiments, it is also possible to use conical or other lapping rotors depending on the finish shape of the workpiece. Further, while the swing was incorporated according to a control program, it is also possible to utilize oscillation of a piezoelectric element for swing incorporation. Further, it is possible to use very fine abrasive particles of colloidal silica (with grain diameter of 0.02 to 0.12 μm) or the like as well as generally employed diamond abrasive particles, and a flatness of about 0.04 μm can be obtained.

As has been described in the foregoing, according to the invention, a rotor is formed by rotationally cutting a metal mass mounted on a machine tool shaft under computer control, its outer periphery is formed with annular grooves by rotational cutting, the rotor is rotated on a shaft while feeding an abrasive to it while a workpiece set on a stage movable along three perpendicular axes, i.e., X-, Y- and Z-axes, urged against the rotor by moving the stage in the Z-axis direction, and the surface of the workpiece is polished by causing the stage to be moved in the X-axis direction and reciprocated in the Y-axis direction, the urging pressure being controlled by measuring it with a pressure sensor. Thus, a block-like workpiece can be polished as such, i.e., without dividing it. In addition, since the extent of polishing can be monitored, the polishing can be automatized under computer control without reducing the machining accuracy. It is thus possible to reduce the number of steps, manual operation and machining time in the polishing operation. Still further, it is possible to polish a thin ceramic plate or like workpiece with high shape accuracy in the longitudinal direction (X-axis direction) and lateral direction (Y-axis direction).

What is claimed is:

1. A method of polishing a workpiece using a machine tool, comprising the steps of, mounting a metal mass on a machine tool shaft, forming a rotor by cutting said metal mass while being rotated on said machine tool shaft under computer control, mounting the workpiece on a three-dimensionally movable stage within said machine tool, rotating said thus formed rotor while feeding an abrasive thereto under computer control, urging said workpiece against said rotor by three-dimensionally moving said stage under computer control, polishing said workpiece with said abrasive, and simultaneously measuring the pressure with which said workpiece is urged against said rotor by using a pressure sensor.

2. The method of polishing according to claim 1, wherein said rotor used for polishing has its outer periphery formed with peripheral annual grooves by rotational grinding, thereby creating a series of discontinuous edges on said rotor periphery and polishing said workpiece with the discontinuous edges on said rotor periphery by movement of said stage under computer control.

3. The method of polishing according to claim 2, wherein said three-dimensionally movable stage is moved in one of three mutually perpendicular directions to produce said urging pressure while it is simultaneously moved in another one of said three mutually perpendicular directions and also reciprocated in the remaining one of said three mutually perpendicular directions and also reciprocated in the remaining one of said three mutually perpendicular directions in order to effect the polishing of said workpiece with the discontinuous edges on said rotor.

4. The method of claim 1 wherein movement of said machine tool shaft and three-dimensionally movable stage is commanded by an NC controller, and providing a control program to said NC controller from a computer which receives the output of said pressure sensor and which is also programmed with polishing condition data to produce said control program.

5. The method of claim 3 wherein movement of said machine tool shaft and three-dimensionally movable stage is commanded by an NC controller, and providing a control program to said NC controller from a computer which receives the output of said pressure sensor and which is also programmed with polishing condition data to produce said control program.

6. A method of polishing comprising the steps of:

providing a rotor by cutting a metal mass rotating on a machine tool shaft under computer control;

rotating the rotor on an axis while feeding an abrasive thereto;

multi-directionally urging a work piece towards the rotor;

polishing the work piece with the abrasive by urging the work piece against the rotor;

measuring a pressure with which the work piece is urged against the rotor to create a signal; and inputting said signal into a computer which uses said signal to generate a control program for simultaneously controlling rotation of said rotor and multi-directional movement of said work piece including the movement urging the work piece against the rotor.

7. A method of polishing comprising the steps of:

providing a rotor by cutting a ceramic mass rotating on a machine tool shaft under computer control;

rotating the rotor on an axis while feeding an abrasive thereto;

multi-directionally urging a work piece towards the rotor;

polishing the work piece with the abrasive by urging the work piece against the rotor;

measuring a pressure with which the work piece is urged against the rotor to create a signal; and inputting said signal into a computer which uses said signal to generate a control program for simultaneously controlling rotation of said rotor and multi-directional movement of said work piece including the movement urging the work piece against the rotor.

8. A method of polishing comprising the steps of:

providing a rotor by cutting a metal mass rotating on a machine tool shaft under computer control, said rotor having peripheral annular grooves formed by rotational grinding;

rotating the rotor on an axis while feeding an abrasive thereto;

multi-directionally urging a work piece towards the rotor;

polishing the work piece with the abrasive by urging the work piece against the rotor;

measuring a pressure with which the work piece is urged against the rotor to create a signal; and inputting said signal into a computer which uses said signal to generate a control program for simultaneously controlling rotation of said rotor and multi-directional movement of said work piece including the movement urging the work piece against the rotor.

9. A method of polishing comprising the steps of:

providing a rotor by cutting a ceramic mass rotating on a machine tool shaft under computer control, said rotor having peripheral annular grooves formed by rotational grinding;

rotating the rotor on an axis while feeding an abrasive thereto;

multi-directionally urging a work piece towards the rotor;

polishing the work piece with the abrasive by urging the work piece against the rotor;

measuring a pressure with which the work piece is urged against the rotor to create a signal; and inputting said signal into a computer which uses said signal to generate a control program for simultaneously controlling rotation of said rotor and multi-directional movement of said work piece including the movement urging the work piece against the rotor.

10. A method of polishing a work piece using a machine tool, comprising the steps of:

mounting a metal mass on a machine tool shaft;

forming a rotor by cutting the metal mass while being rotated on the machine tool shaft under computer control;

mounting the work piece on a three-dimensionally movable stage within said machine tool;

rotating the formed rotor while feeding an abrasive thereto under computer control;

urging said work piece against said rotor by three-dimensionally moving the stage under computer control, and polishing the work piece with the abrasive.

11. The method of polishing according to claim 10, wherein the step of forming the rotor includes the steps of;

forming the rotor with peripheral annual grooves by rotationally grinding, thereby creating a series of discontinuous edges on said rotor periphery; and polishing said work piece with the discontinuous edges on said rotor periphery by movement of the work piece relative to the rotor.

12. The method of polishing according to claim 10, wherein said three-dimensionally movable stage is moved in one of three mutually perpendicular directions to produce said urging pressure while it is simultaneously moved in another one of said three mutually perpendicular directions and also reciprocated in the remaining one of said three mutually perpendicular directions in order to effect the polishing of said work piece with the discontinuous edges on said rotor.

13. A method of polishing a work piece using a machine tool, comprising the steeps of:

mounting a metal mass on a machine tool shaft;

forming a rotor by cutting the metal mass while being rotated on the machine tool shaft;

mounting the work piece on a moveable stage within said machine tool;

rotating said formed rotor while feeding an abrasive thereto;

urging said work piece against said rotor by moving said stage; and polishing the work piece with the abrasive.

14. A method of polishing a work piece using a machine tool, comprising the steps of:

mounting a ceramic mass on a machine tool shaft;

forming a rotor by cutting the ceramic mass while being rotated on the machine tool shaft;

mounting the work piece on a moveable stage within said machine tool;

rotating said formed rotor while feeding an abrasive thereto;

urging said work piece against said rotor by moving said stage; and polishing the work piece with the abrasive.

15. A method polishing a work piece using a machine tool, comprising the steps of:

providing a rotor rotating about an axis;

mounting said work piece on a moveable stage within said machine tool;

feeding an abrasive onto said rotor;

urging said work piece against said rotor by moving the stage;

polishing the work piece with the abrasive;

providing a pressure sensor, simultaneously with said step of polishing;

measuring the pressure with which the work piece is urged against the rotor by means of said pressure sensor;

controlling the step of urging said work piece in response to said sensed pressure; and controlling the rotational speed of said shaft in response to said sensed pressure.

16. A method of polishing a work piece using a computer controlled machine tool, comprising the steps of:

rotating a rotor on an axis while feeding an abrasive thereto;

multi-directionally moving the work piece, including urging the work piece towards the rotor in a first direction and simultaneously moving the work piece in a second direction transverse to said first direction;

polishing the work piece with the abrasive by urging the work piece against the rotor;

measuring a pressure with which the work piece is urged against the rotor to create a signal; and inputting said signal into a computer which uses said signal to generate a control program for simultaneously controlling rotation of said rotor and multi-directional movement of said work piece including the movement urging the work piece against the rotor; and wherein the step of multi-directionally urging a work piece towards the rotor comprises three-dimensional movement in three mutually orthogonal directions, coordinating the simultaneous movements such that the polishing action due to movement in the first direction and the polishing action due to the speed in the second direction yields the surface polishing desired; and wherein the first of the three mutually orthogonal directions includes movement towards and away from the axis of the rotor, the second of the three mutually orthogonal directions includes high speed, reciprocating movement in a cross feed direction, parallel to the axis of the rotor, and the third of the three mutually orthogonal directions includes feed movement perpendicular to both the first direction and the second direction.

17. A method of polishing a work piece according to claim 16, wherein:

said high speed, reciprocating movement is performed at a peak, linear speed greater than 500 mm/min.

* * * * *